US011806565B2

(12) United States Patent
Fanning et al.

(10) Patent No.: US 11,806,565 B2
(45) Date of Patent: Nov. 7, 2023

(54) EXERCISE WEIGHT

(71) Applicants: Thomas Fanning, Los Angeles, CA (US); Michael Joson, Haverford, PA (US)

(72) Inventors: Thomas Fanning, Los Angeles, CA (US); Michael Joson, Haverford, PA (US)

( * ) Notice: Subject to any disclaimer, the term of this patent is extended or adjusted under 35 U.S.C. 154(b) by 148 days.

(21) Appl. No.: 17/315,441

(22) Filed: May 10, 2021

(65) Prior Publication Data

US 2021/0353990 A1 Nov. 18, 2021

Related U.S. Application Data

(63) Continuation of application No. 29/758,426, filed on Nov. 16, 2020, now Pat. No. Des. 954,859.
(Continued)

(51) Int. Cl.
*A63B 21/00* (2006.01)
*A63B 21/06* (2006.01)
(Continued)

(52) U.S. Cl.
CPC ..... *A63B 21/0004* (2013.01); *A63B 21/06* (2013.01); *A63B 21/4039* (2015.10);
(Continued)

(58) Field of Classification Search
CPC ..... A63B 21/0004; A63B 21/0601; A63B 21/0602; A63B 21/0603; A63B 21/0604;
(Continued)

(56) References Cited

U.S. PATENT DOCUMENTS 4,303,239 A 12/1981 Walsh, Jr.
4,538,806 A * 9/1985 Wilkerson ..... A63B 21/0603 482/108
(Continued)

FOREIGN PATENT DOCUMENTS

CN 2151777 1/1994
CN 104162251 A 11/2014
(Continued)

OTHER PUBLICATIONS

Golds Gym, Dumbells Weights Set for Women Dumbbell with Rack Neoprene Hand Weight 3 Lb 5 Lb 8 Lb for Fitness Exercises, Aug. 26, 2020, https://www.amazon.com/Dumbells-Weights-Dumbbell-Neoprene-Exercises/dp/B00UHRTT9Y.

*Primary Examiner* — Sundhara M Ganesan
*Assistant Examiner* — Zachary T Moore
(74) *Attorney, Agent, or Firm* — Argus Intellectual Enterprise; Jordan Sworen; Daniel Enea

(57) ABSTRACT

An exercise apparatus for strengthening muscles. The exercise apparatus includes a body having a holding portion that extends between a first distal region and second distal region thereof. The holding portion forms a continuous surface that is curved such that a diameter of the holding portion is narrowest at a proximal point of the holding portion and widest at a first radial edge and an opposing second radial edge. The first and second distal regions are each dome shaped and extend from the first radial edge and the second radial edge, respectively. The holding portion can be received between the inner thighs of a user to add resistance when performing various exercises, such as leg lifts, planks, pull-ups, dips, and the like. In some embodiments, the body includes a weight receiving channel extending therethrough, wherein an elongated weight is positioned within the weight receiving channel.

20 Claims, 5 Drawing Sheets

Related U.S. Application Data

(60) Provisional application No. 63/026,380, filed on May 18, 2020.

(51) Int. Cl.
*A63B 23/04* (2006.01)
*A63B 23/02* (2006.01)
*A63B 23/035* (2006.01)

(52) U.S. Cl.
CPC .... *A63B 23/0216* (2013.01); *A63B 23/03516* (2013.01); *A63B 23/0482* (2013.01); *A63B 2208/0252* (2013.01); *A63B 2225/02* (2013.01)

(58) Field of Classification Search
CPC ..... A63B 21/0605; A63B 21/0606; A63B 21/0607; A63B 21/072; A63B 21/0724; A63B 21/0726; A63B 21/075; A63B 23/0216; A63B 23/03516; A63B 23/0482
See application file for complete search history.

(56) References Cited

U.S. PATENT DOCUMENTS

| | | | | |
|---|---|---|---|---|
| 4,911,434 | A | 3/1990 | Herring | |
| 5,102,123 | A | 4/1992 | Roark | |
| 5,489,251 | A | 2/1996 | Robles, Jr. | |
| 5,868,652 | A | 2/1999 | Spletzer | |
| 6,599,222 | B2 * | 7/2003 | Wince | A63B 21/0722 482/106 |
| D708,754 | S * | 7/2014 | Harangvolgyi | D24/211 |
| 8,951,169 | B1 * | 2/2015 | Casper | A63B 21/4035 482/106 |
| 10,434,359 | B2 * | 10/2019 | Feng | A63B 21/0603 |
| 2013/0090212 | A1 | 4/2013 | Wang | |
| 2014/0005012 | A1 * | 1/2014 | Wang | A63B 21/0726 482/108 |
| 2014/0272851 | A1 | 9/2014 | Reavy | |
| 2015/0165267 | A1 * | 6/2015 | Erickson | A63B 23/0222 482/112 |
| 2015/0251043 | A1 * | 9/2015 | Holderbaum | A63B 21/075 482/108 |
| 2017/0087407 | A1 | 3/2017 | Kravchenko | |
| 2018/0078811 | A1 * | 3/2018 | Chen | A63B 23/12 |
| 2019/0247698 | A1 * | 8/2019 | Feng | A63B 21/0603 |
| 2021/0022954 | A1 * | 1/2021 | Jones | A63B 21/075 |

FOREIGN PATENT DOCUMENTS

| | | | |
|---|---|---|---|
| CN | 108635739 | A | 10/2018 |
| EP | 0135635 | A1 * | 4/1985 |
| KR | 101123657 | B1 | 3/2012 |
| KR | 101123657 | B1 * | 3/2020 |

* cited by examiner

EXERCISE WEIGHT

CROSS REFERENCE TO RELATED APPLICATION

This application claims the benefit of U.S. provisional application No. 63/026,380 filed on May 18, 2020 and U.S. Design application No. 29/758,426 filed on Nov. 16, 2020, the above identified patent application is herein incorporated by reference in its entirety.

BACKGROUND OF THE INVENTION

The present invention relates to an exercise apparatus. More specifically, the present invention relates to an exercise apparatus that is adapted to be received between the legs of a user and lifted therewith. The exercise apparatus comprises a body having a continuous surface that is curved so that the right and left side may be positioned between the inner thighs of the user. In this way, the present invention provides an apparatus for exercising the abdominal muscles and other core muscle groups.

Common weight structures fail to allow for ease of exercise of the legs and core of the user, especially when the user is in the supine position. Known weights are advantageous for gripping by hands and manipulated as needed to target general or particular muscle groups. Some users attempt to place these weights behind the knee or lower thigh region to engage core and lower muscles. However, these known weights are not shaped to be coupled to the user during the exercise. Similarly, some users attempt to use place a round shaped weight, such as a medicine ball, between their legs to perform abdominal exercises. However, these weights are not designed to be lifted between a user's legs and can cause discomfort. Moreover, lifting weights in such an unstable manner creates a risk of causing injury.

Many of these weight systems are not designed to target the abdominal and core region or, alternatively, are not designed to solely target the abdominal region. Instead, these known weight systems target various additional muscle groups without focusing on the user's core while an exercise is performed.

Further, some individuals who have hand and wrist injuries often experience impaired movement making it difficult or painful to grasp objects or form a closed fist. These impairments often prevent a person from performing strength exercises because they are unable to grip a dumbbell, resistance band, or other exercise equipment handle. Existing exercise equipment does not permit a user to perform exercises without placing a handle or other type of grasping mechanism in the palm of their hand, requiring them to put strain on injured hand and wrist muscles and ligaments. Therefore, there exists a need for an exercise apparatus that is designed to focus on the abdominal region that is configured to be held between the inner thighs of a user to add resistance while performing leg lifts while in the supine position.

In light of the devices disclosed in the known art, it is submitted that the present invention substantially diverges in design elements and methods from the known art and consequently it is clear that there is a need in the art for an improvement for an exercise apparatus. In this regard the instant invention substantially fulfills these needs.

SUMMARY OF THE INVENTION

In view of the foregoing disadvantages inherent in the known types of weights now present in the known art, the present invention provides an exercise apparatus for placement between the legs of a user for performing various strengthening exercises.

It is an objective of the present invention to provide an embodiment of an exercise apparatus comprising a body shaped to fit between the legs of the user.

It is another objective of the present invention to provide an embodiment of the exercise apparatus comprising a body having a holding portion that extends between a first distal region and second distal region, wherein the holding portion is adapted to be received within the thighs of the user.

It is another objective of the present invention to provide an embodiment of the exercise apparatus wherein the holding portion forms a continuous surface that is curved such that a diameter of the holding portion is narrowest at a proximal point of the holding portion and widest at a first radial edge and an opposing second radial edge.

It is another objective of the present invention to provide an embodiment of the exercise apparatus wherein the first and the second distal regions are each dome shaped and extend from the first radial edge and a second radial edge, respectively.

It is another objective of the present invention to provide an embodiment of the exercise apparatus comprising a weight receiving channel extending through the body, wherein a generally elongated weight is positioned within the weight receiving channel and calibrated in weight units.

It is therefore an object of the present invention to provide a new and improved apparatus that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for performing leg lift exercises while holding the exercise apparatus between the legs of the user. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
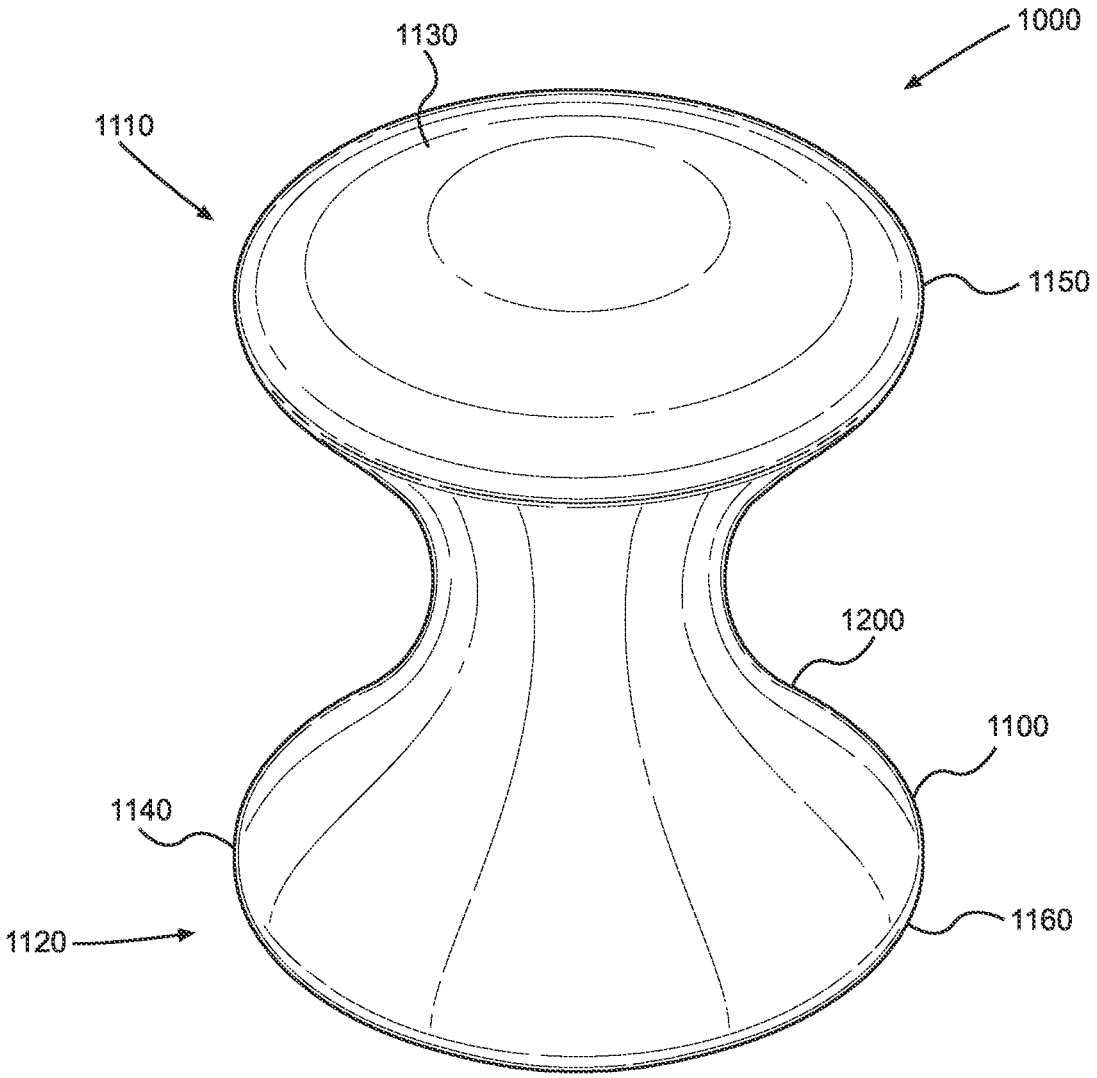
FIG. 1 shows a perspective view of an embodiment of the exercise apparatus.
Figure 2:
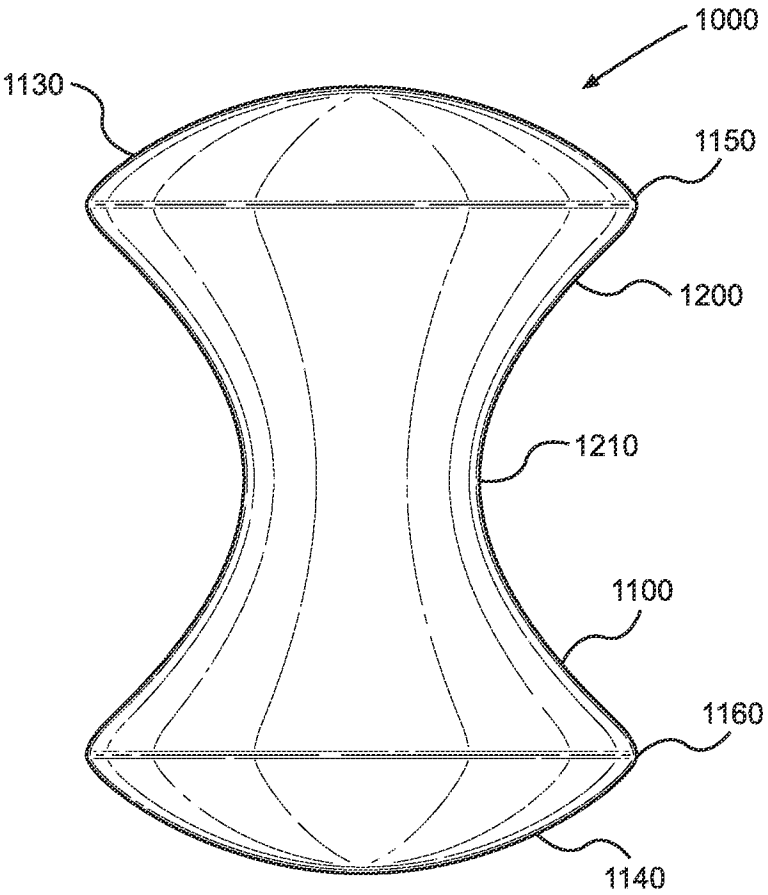
FIG. 2 shows a side view of an embodiment of the exercise apparatus.

Referring now to FIGS. 1 and 2, there is shown a perspective view and a side view of an embodiment of the exercise apparatus, respectively. The exercise apparatus 1000 provides a weight that is sized and adapted to be selectively placed between the legs of a user, such that the user may compress the weight and perform leg lift exercises from a supine, prone, seated, among other positions. In this way, the present invention provides an apparatus for exercising the abdominal muscles and other core muscles.

In the illustrated embodiment, the exercise apparatus 1000 comprises a body 1100 having a first distal region 1130, an opposing second distal region 1140, and a holding portion 1200 that extends between a first end 1110 and a second end 1120 of the body. The holding portion 1200 is adapted to be received between the thighs of the user by forming a continuous surface that is curved such that a diameter of the holding portion 1200 is narrowest at a proximal point 1210 of the holding portion 1200 and widest at a first radial edge 1150 and a second radial edge 1160. The continuous lateral surface is curved having a depth that extends into the body 1100.

In the illustrated embodiment, the exercise apparatus 1000 forms a flared cylinder that resembles an apple core shape. In the illustrated embodiment, an exterior perimeter of the body 1200 comprises a circular shaped cross section taken along any horizontal plan thereof. The body 1100 is symmetrical about a horizontal and vertical plane extending through a center point of the body. In this way, the rotational position of the exercise apparatus 1000 does not materially affect the engagement of the legs of the user.

In some embodiments, the exercise apparatus 1000 is constructed of a rigid material to provide an optimal stability for performing exercises therewith, such as urethane rubber, metal, or the like. In some embodiments, an exterior of the exercise apparatus 1000 is coated or covered with a rubber material or other soft material to allow the user to more comfortably receive the exercise apparatus 1000 against their body when performing an exercise.

In the illustrated embodiment, the geometry of the lateral continuous curve of the holding portion 1200 is functionally adapted to form around a portion of the thigh of the user. In the illustrated embodiment, the largest diameter, disposed along the radial edges, is between 7.5 and 8 inches and the smallest diameter, found along the proximal point of the holding portion 1200, is between 3 and 3.5 inches. The ratio between the largest and smallest diameter is between 2.3 and 2.7 units. As used herein, "unit" or "units" are in inches, however the ration holds for other units of measurement. The lateral continuous curve is formed between the radial edges 1150, 1160 and the ratio between the proximal and distal diameters indicate the depth of the curve. The purpose of describing the diameter differences formed by the lateral continuous curve is to demonstrate the depth formed by the exercise apparatus 1000 so as to secure around the top portion and bottom portion of each thigh of the user when placed therebetween. These are approximate measurements of an embodiment. In other embodiments, a preferred unit range is between +/−30% of the units described in the illustrated embodiment. In other embodiments, a more preferred unit range is between +/−10% of the units described in the illustrated embodiment.

In some embodiments, the lateral continuous curve comprises a concave surface that when viewed from a side elevation view forms an arc imposed on a circle, wherein the circle comprises a radius and a chord length. The exercise apparatus forms a chord length of approximately 2.72 units. The unit lengths are intended to describe the scale of the holding portion 1200 and the first and second distal regions 1130, 1140. The imposed circle has an approximate radius of 1.48 units and the internal angle between the uppermost and lowermost intersection points of the circumference and the exercise apparatus 1000 is approximately 143 degrees. The arc length between the uppermost and lowermost of the exercise apparatus 1000 is 3.69 units. These are approximate unit measurements of an embodiment. In other embodiments, a preferred unit range is between +/−30% of the units described herein. In other embodiments, a more preferred unit range is between +/−10% of the units described herein. The purpose of describing the arc formed by the lateral continuous curve is to demonstrate the depth formed by the exercise apparatus 1000 so as to secure around the top portion and bottom portion of each thigh of the user when placed therebetween. If the depth is too shallow, the exercise apparatus 1000 would not be stably received by the user and the user would be unable to successfully perform exercises therewith.

Figure 3:
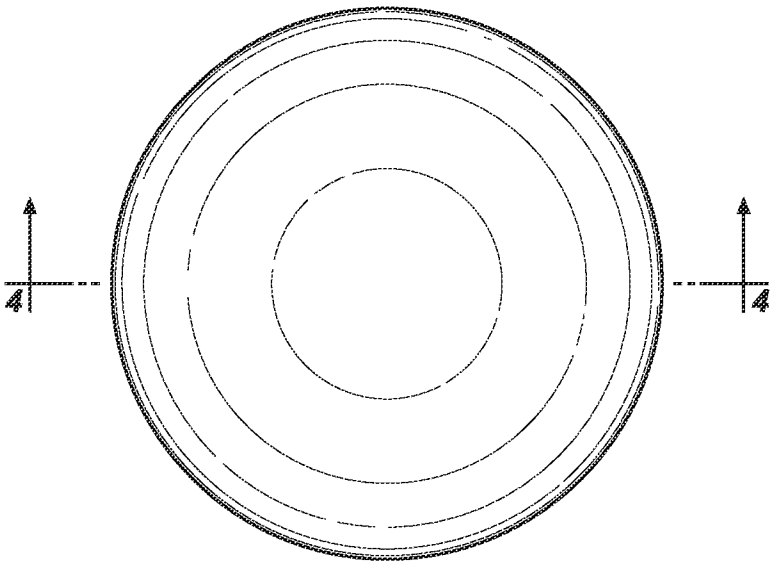
FIG. 3 shows a top plan view of an embodiment of the exercise apparatus.

Referring now to FIGS. 2 and 3, there is shown the side view and a top plan view of an embodiment of the exercise apparatus, respectively. In the illustrated embodiment, the first and second distal regions 1130, 1140 are each dome shaped and extend from the first radial edge 1150 and the second radial edge 1160, respectively. The dome shape provides for a round radial edge 1150 to provide comfort to the user, as well as provide additional interior volume for retaining a weighted element in the body 1120.

Figure 4:
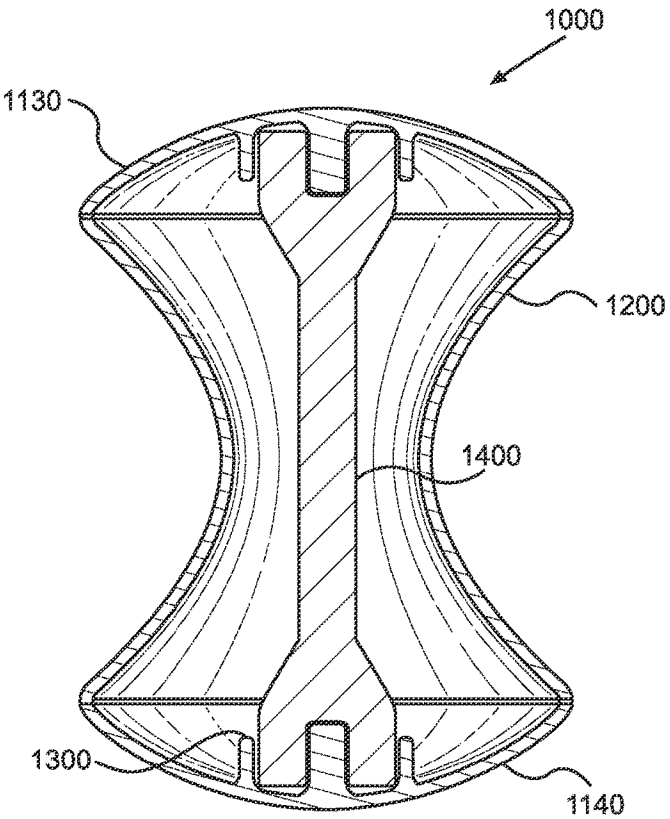
FIG. 4 shows a cross sectional view of an embodiment of the exercise apparatus taken along line 4-4 of FIG. 3.

Referring now to FIG. 4, there is shown a cross sectional view of an embodiment of the exercise apparatus taken along line 4-4 of FIG. 1. In the illustrated embodiment, the exercise apparatus 1000 comprises a weight receiving channel 1300 extending through an interior volume of the body 1200. The ends of the weight receiving channel 1300 are disposed in the distal regions 1130, 1140 of the apparatus 1000 and configured to secure a weight 1400 therein. In the shown embodiments, the weight receiving channel 1300 comprises a pair of recesses 1310 separated by a wall 1320. In the illustrated embodiment, the weight receiving channel 1300 does not extend through the holding portion 1200. In alternate embodiments, the weight receiving channel 1300 extends through the holding portion 1200.

The weight 1400 disposed within the weight receiving channel 1300 is generally elongated so as to extend from the first distal region 1130, through the holding portion 1200, and to the second distal region 1140. The distal ends of the weight 1400 comprise a pair of protrusions 1410 that interlock within the pair of recesses of the weight receiving channel 1300. The wall 1320 of the weight receiving channel 1300 is received by an aligned weight recess 1420 of the weight. The weight 1400 is calibrated in weight units that correlate to the overall weight of the exercise apparatus and indicates to the user the amount of weight being lifted. For example, a heavier weight 1400 is disposed within the body 1200 for an exercise apparatus that weighs 20 lbs and a lighter weight is disposed in an exercise apparatus that weighs 10 lbs. However, regardless of the weight of the exercise apparatus 1000, the overall dimension and shape of the exercise apparatus remains unchanged. The difference between a first exercise apparatus and a second exercise apparatus weighing different amounts is the weight 1400 disposed therein. In the illustrated embodiment, only a single weight 1400 is receivable by the exercise apparatus 1000.

Figure 5:
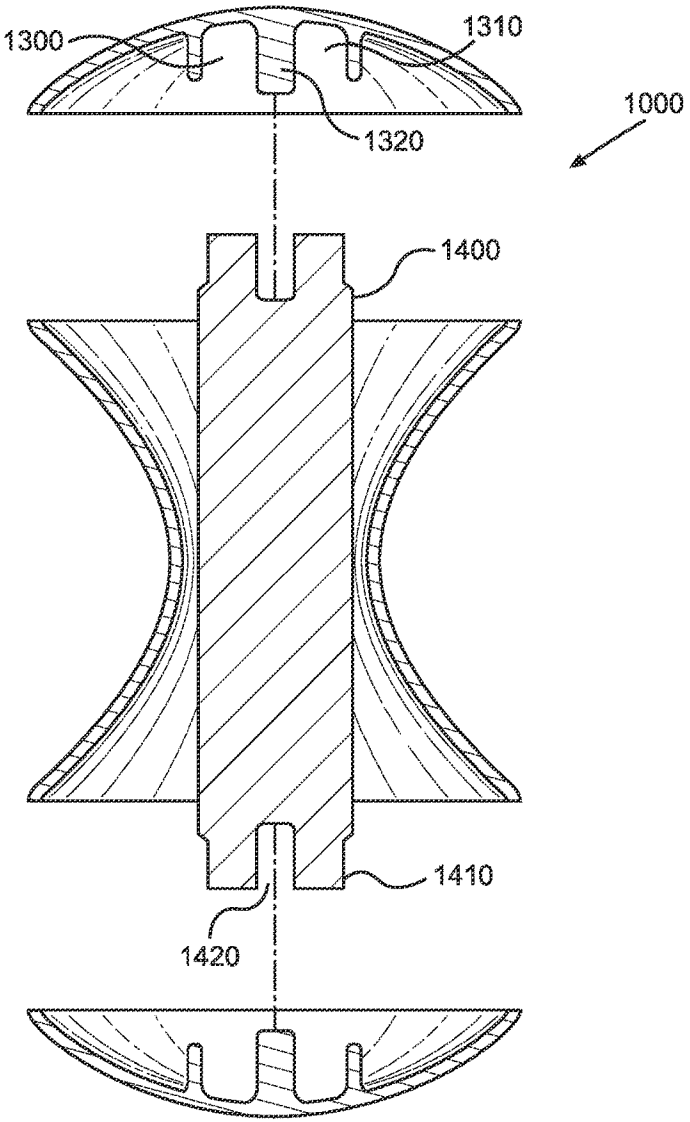
FIG. 5 shows a cross sectional and exploded view of another embodiment of the exercise apparatus.

Referring now to FIG. 5, there is shown a cross sectional and exploded view of another embodiment of the exercise apparatus. In some embodiments, the exercise apparatus 1000 is formed by securing the first and second distal regions 1130, 1140 to the holding portion 1200 along first and second radial edges 1150, 1160, respectively. In some embodiments, at least one distal region is separable from the holding portion so as to interchange the weight 1400 within the weight receiving channel 1300.

Figure 6:
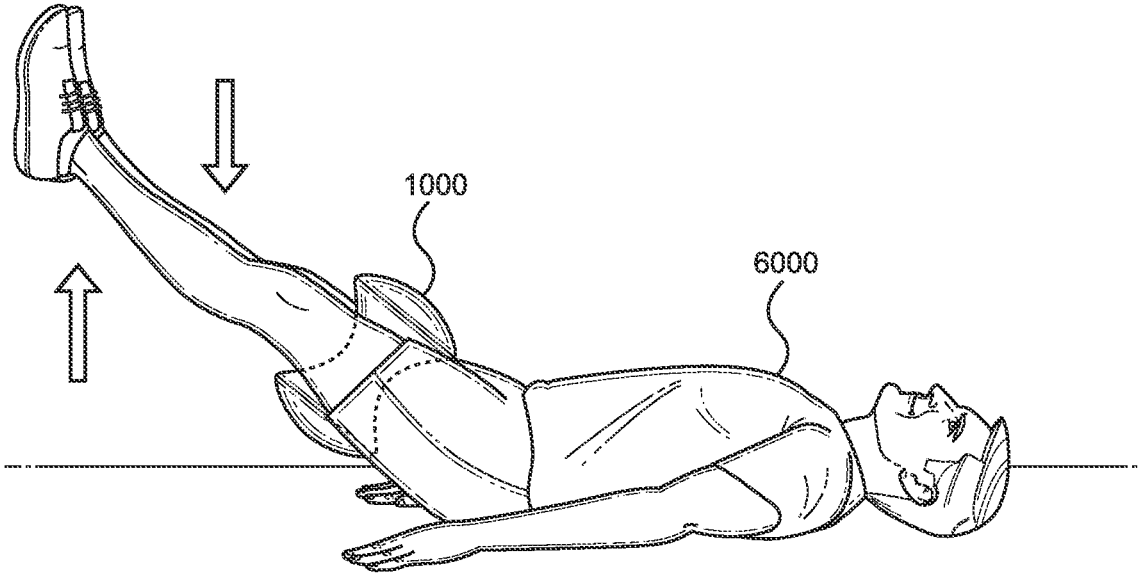
FIG. 6 shows a perspective view of an embodiment of the exercise apparatus in use.
Figure 7:
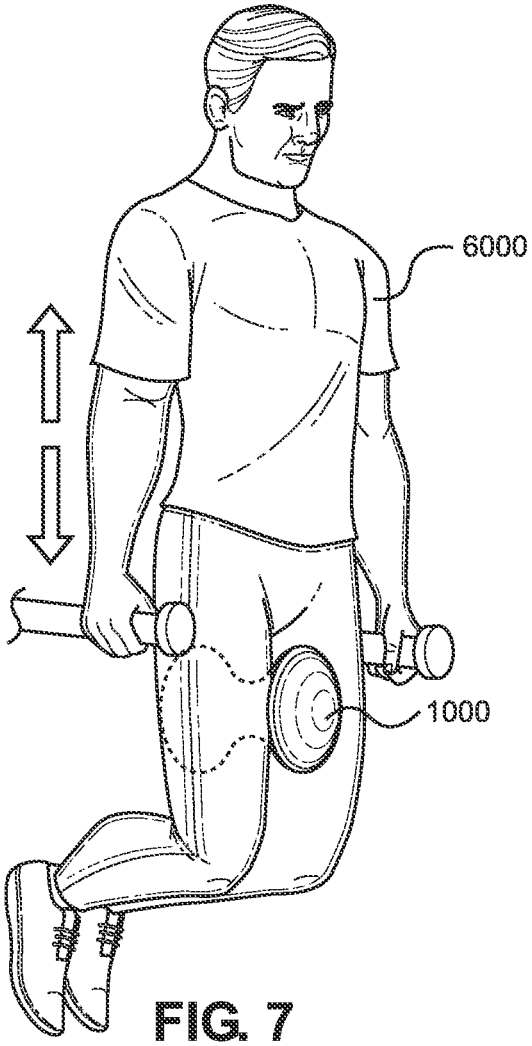
FIG. 7 shows another perspective view of an embodiment of the exercise apparatus in use.
Figure 8:
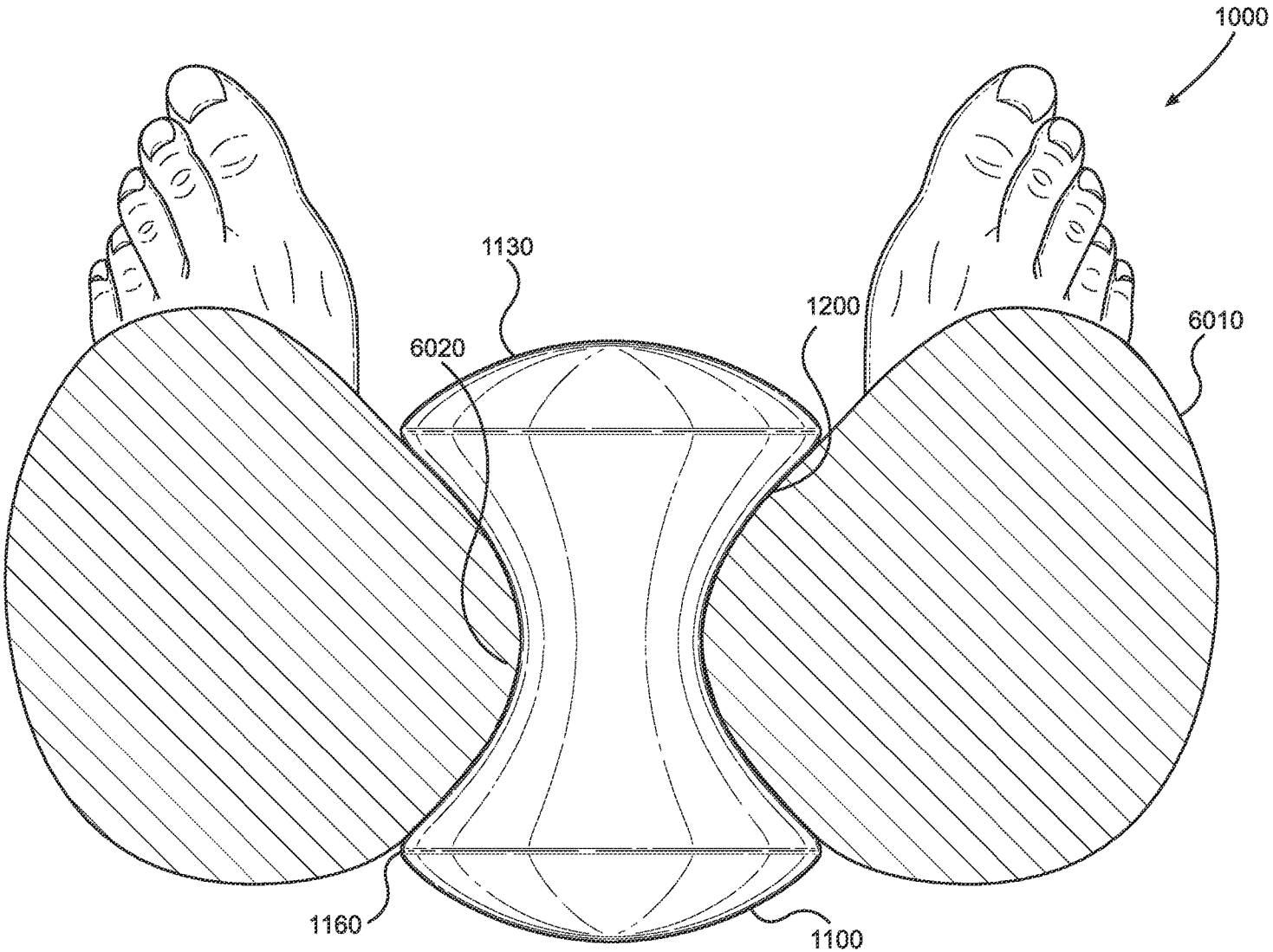
FIG. 8 shows a side view of an embodiment of the exercise apparatus positioned between a cross sectional view of a user's thighs.

Referring now to FIGS. 6 and 7, there are shown perspective views of an embodiment of the exercise apparatus in use. In operation, the exercise apparatus 1000 is positioned between a pair of inner thighs of a user, above the knees. In one embodiment, the surface of the continuous curve of the holding portion is configured to rest flush against a user's thighs (as seen in FIG. 8). In the illustrated embodiment, the exercise apparatus extends up to 8 inches radially from a longitudinal axis so as to encompass a substantial portion of the received leg of the user. The radial edges are adapted to rest on top of or underneath the thighs of the user. The exercise apparatus 1000 is adapted to be used simultaneously while the user is in the supine, prone, upright, or seated position and performing body exercises, such as leg lifts, body dips, pullups, among many other exercises.

In one embodiment, a method of exercising a muscle of a user comprises providing an exercise apparatus including a body having a holding portion that extends between a first distal region and an opposing second distal region, wherein the holding portion forms a continuous surface that is curved such that a diameter of the holding portion is narrowest at a proximal point of the holding portion and widest at a first radial edge and an opposing second radial edge, wherein the first and second distal regions are each dome shaped and extend from the first radial edge and the second radial edge, respectively; positioning the exercise apparatus between a pair of corresponding thighs of the user, such that the first distal region is positioned over a top of the pair of thighs and the second distal region is positioned on an opposing side of the pair of thighs; moving the body of the user while simultaneously holding the exercise apparatus between his or her thighs.

In one preferred method of use, the exercise apparatus is held between the thighs of a user during an 8" to 12" leg lift exercise in the supine position to directly target and strengthen the core muscles of the user by adding weight resistance to the exercise. In other uses, the exercise apparatus is held between the thighs of the user in an exact same position as the leg lift is performed, to perform other exercises, such as dips, pull ups, planks, and the like, to add weight resistance.

Referring now to FIG. 8, there is shown a side view of an embodiment of the exercise apparatus positioned between a cross sectional view of a user's thighs. The exercise apparatus 1000 is ergonomically designed to be held between the thighs 6010 of the user, above the knee. In the shown method of use, the surface of the continuous curve formed between of the two radial edges 1160 of the holding portion 1200 is configured to rest flush against the inner surfaces 6020 of the thighs of the user, wherein the distal regions 1130 of the body 1100 of the exercise apparatus 1000 are adapted to rest on top of or underneath the thighs of the user. The continuous curved surface of the holding region 1200 allows user to comfortably receive the exercise apparatus between his or her thighs and the dome shape of the distal regions prevents any interference thereof with the user while performing an exercise.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise weight for positioning between a pair of thighs of a user, comprising:

a body having a holding portion that extends between a first distal region and an opposing second distal region;

wherein the body comprises a weight that extends from the first distal region to the second distal region;

wherein the holding portion forms a continuous surface that is curved such that a diameter of the holding portion is narrowest at a proximal point of the holding portion and widest at a first radial edge and an opposing second radial edge;

wherein the holding portion is adapted to be received between the pair of thighs of the user;

wherein the first and second distal regions are each dome shaped and extend from the first radial edge and the second radial edge, respectively;

wherein the first radial edge and the second radial edge form a largest diameter of the body.

2. The exercise weight of claim 1, wherein the body resembles an apple core shape.

3. The exercise weight of claim 1, wherein the body comprises rotational symmetry about a longitudinal axis, wherein the longitudinal axis extends between the first and second distal regions.

4. The exercise weight of claim 3, wherein a weight receiving channel extends along the longitudinal axis and configured to receive the weight therein.

5. The exercise weight of claim 4, wherein the weight is interchangeable with a second weight configured to be received within the weight receiving channel, wherein the second weight comprises a different calibration.

6. The exercise weight of claim 3, further comprising horizontal symmetry about a horizontal axis of the proximal point.

7. The exercise weight of claim 1, further comprising a weight receiving channel extending through the body, wherein the weight is positioned within the weight receiving channel.

8. The exercise weight of claim 7, wherein the weight comprises a pair of fasteners at either end thereof, the fasteners are adapted for securing to both the first and second distal region, respectively.

9. The exercise weight of claim 7, wherein the weight receiving channel does not extend through the holding portion.

10. The exercise weight of claim 7, wherein the weight receiving channel comprises a pair of recesses separated by a wall and the weight comprises a pair of protrusions at each distal end thereof that interlock within the pair of recesses of the weight receiving channel, wherein the wall of the weight receiving channel is received by an aligned weight recess of the elongated weight.

11. The exercise weight of claim 1, wherein a heaviness of the weight corresponds to an overall weight amount of the exercise weight, such that the heaviness of the weight indicates the total weight amount of the exercise weight.

12. The exercise weight of claim 1, where the first radial edge and the second radial edge have a diameter at least 2.3 times larger than the diameter of the proximal point of the holding portion.

13. The exercise weight of claim 1, wherein the first and second distal regions are end caps that are removably secured to the holding portion.

14. The exercise weight of claim 1, wherein the body is rigid such that the shape of the exercise weight remains unchanged by a heaviness of the weight.

15. The exercise weight of claim 1, wherein a length of the weight extends an entire length of the holding portion.

16. The exercise weight of claim 1, wherein the weight extends into both the first distal region and second distal region simultaneously.

17. A method of exercising a muscle of a user, comprising:

providing an exercise weight comprising a body having a holding portion that extends between a first distal region and an opposing second distal region, wherein the holding portion forms a continuous surface that is curved such that a diameter of the holding portion is narrowest at a proximal point of the holding portion and widest at a first radial edge and an opposing second radial edge, wherein the first and second distal regions are each dome shaped and extend from the first radial edge and the second radial edge, respectively, wherein the first radial edge and the second radial edge form a largest diameter of the body, and wherein the body comprises a weight that extends from the first distal region to the second distal region;

positioning the exercise apparatus between a pair of corresponding thighs of the user, such that the first distal region is positioned over a top of the pair of thighs and the second distal region is positioned on an opposing side of the pair of thighs;

moving the pair of thighs while simultaneously holding the exercise apparatus therebetween.

18. The method of claim 17, further comprising lifting legs of the user while the user is in a supine position.

19. The method of claim 17, wherein the exercise apparatus is positioned above knees of the user.

20. The method of claim 17, wherein an entire surface of the continuous curve formed between of the two radial edges of the holding portion is configured to rest flush against inner surfaces of the thighs of the user.

* * * * *